US007917990B2

(12) United States Patent
Moroz

(10) Patent No.: US 7,917,990 B2
(45) Date of Patent: Apr. 5, 2011

(54) APPARATUS FOR DUCT CLEANING

(76) Inventor: Doug Moroz, Sudbury (CA)

( * ) Notice: Subject to any disclaimer, the term of this patent is extended or adjusted under 35 U.S.C. 154(b) by 1042 days.

(21) Appl. No.: 11/692,049

(22) Filed: Mar. 27, 2007

(65) Prior Publication Data

US 2008/0235900 A1 Oct. 2, 2008

(51) Int. Cl.
*A47L 5/14* (2006.01)
*A47L 9/06* (2006.01)
*B08B 9/035* (2006.01)

(52) U.S. Cl. ..... 15/314; 15/328; 15/327.6; 15/345; 15/346

(58) Field of Classification Search ..... 15/304, 15/312.2, 314, 327.6, 328, 345, 346; *A47L 5/14, A47L 9/06; B08B 9/35*
See application file for complete search history.

(56) References Cited

U.S. PATENT DOCUMENTS 3,220,042 A * 11/1965 Harrington, Sr. ..... 15/325
6,372,052 B1 * 4/2002 Jones ..... 134/21

* cited by examiner

*Primary Examiner* — David A Redding
(74) *Attorney, Agent, or Firm* — Gordon Thomson

(57) ABSTRACT

A duct cleaning apparatus for cleaning ventilation ducts in a household environment comprises a typical household or light industrial vacuum cleaning having a sealed container, a blower having suction and exhaust, a first flexible hose attached to the suction port and a second flexible hose attached to the exhaust port. The hoses are adjacent and parallel to each other and fixed together using a plurality regularly spaced elastic bands. A blower nozzle and a suction nozzle are adjacent to each other and placed in a duct for cleaning. The blower nozzle directs a jet of air into the vacuum zone of the suction nozzle thereby agitating dirt and debris within the vacuum zone for a more efficient cleaning action.

17 Claims, 7 Drawing Sheets

APPARATUS FOR DUCT CLEANING

FIELD OF THE INVENTION

This invention relates to apparatus for brushing, scrubbing and general cleaning and attachments for a vacuum cleaner and pipe, tube or conduit cleaner and more particularly relates to an apparatus for duct cleaning.

BACKGROUND OF THE INVENTION

Many homes in North America rely upon forced air heating and cooling systems. Air is distributed throughout the house by a network of ducts. These ducts are prone to trapping dirt and debris which can reduce the efficiency of the furnace, clog furnace filters, exacerbate allergies and generally make it difficult for the house owner to maintain a dust free environment. The frequency at which ducts should be cleaned varies from once per year to once every five years depending on conditions in and around the home. Homes near construction zones, homes with pets or homes where the owners have allergies need to be cleaned more often than usual. Recently renovated homes, new homes, resale homes and homes with new furnaces should also have their ducts cleaned. A duct cleaning operation can remove several pounds of dust and debris from the duct system. A typical duct cleaning contractor may charge between $300 and $600 for a duct cleaning operation. It requires the installation of bulky and noisy equipment and a large truck to carry the suction motor and filters. During such an operation, the home owner is forced out of the home due to noise. Numerous patents disclose attempts at providing a duct cleaning apparatus for use in the home that is both efficient and cost-effective. However, they fail to do so for a variety of reasons. For example, U.S. Pat. No. 5,107,568 Duct Sweeper issued to Wade on Apr. 28, 1992 discloses a duct sweeper having a turbine and motorized head. Such a device is expensive and heavy to operate and cannot be used with existing household vacuum cleaners. U.S. Pat. No. 5,802,667 Duct Cleaning Device issued to Williams on Sep. 8, 1998 discloses a device comprising a brush attached to the end of a suction hose and then inserted into the duct and moved in a scrubbing back-and-forth motion. Such a device is not effective because much of the debris remains in the duct and outside the vacuum zone of the nozzle which is partially obscured by the brush.

Therefore, there is a health and financial benefit to increasing the frequency and reducing the cost of duct cleaning by providing a duct cleaning apparatus that is easily attached to a household vacuum cleaner and easily used by the householder to clean dust and debris from ducts on a regular basis.

SUMMARY OF THE INVENTION

In one example of the invention there is provided a duct cleaning apparatus comprising a sealed container having a volume for collecting debris suctioned from the duct. The container contains a negative pressure. There is further provided a blower as means for creating the negative pressure within said sealed container. A suction hose is attached to the container. A blower hose is attached to the blower exhaust connector. Suction hose pressure and blower hose pressure is regulated by a sliding valve on a body connected between the suction hose and the suction connection and between the blower hose and the blower connection. The blower hose and the suction hose are hold together in a parallel arrangement by a plurality of elastic bands spaced regularly along the length of the hose. The free end of the blower hose is equipped with a nozzle to direct air in a radial manner in to the duct. The end of the suction hose also has a nozzle for drawing debris into the hose. The blower nozzle and the suction nozzle are adjacent to each other. The blower nozzle is angled in such a manner so as to blow air radially into the vacuum zone of the suction nozzle. The vacuum zone is the zone of effective suction. Air blown into the vacuum zone has the effect of agitating free dust and dirt for suction into the suction hose.

In another example of the invention the suction and blower hoses may be sectioned for easy assembly, disassembly and storage.

In yet another example of the invention the blower nozzle comprises a first part for blowing air into the duct, a second part for permanently connecting to the second end of the second hose; and, a third part for temporarily attaching the first nozzle to the second nozzle during duct cleaning operations.

In one example of the invention the first part of the blower nozzle comprises a first tube having an outside diameter, an inside diameter, a length, a lumen, a top surface area, a bottom surface area, a first tube first end and a first tube second end. The top and bottom surface areas are perforated with a plurality of equally-sized holes. There are more holes on the top surface than the bottom surface. The first tube further comprises an axis inclined downward at a predetermined angle so that air exiting the apertures impinges within the vacuum zone of the second nozzle.

In another example of the invention the second part of the blower nozzle comprises a flange, a flange aperture and a second tube having an outside diameter, an inside diameter, a length, a lumen, a top surface area and a bottom surface area, a second tube first end and a second tube second end.

In still another example of the invention the third part of the blower nozzle comprises a resilient member projecting rearward from the flange. The member comprises an aperture. The member cooperates with the encircling pointed band so that end of the second nozzle may be placed between the resilient member and the encircling pointed band in abutment against the flange and held compressively thereby temporarily fixing the first nozzle to the second nozzle during duct cleaning operations.

In one example of the invention the hoses are attached to each other in parallel by plurality of elastic bands adapted to encircle the first and second hoses at regularly spaced intervals.

OBJECTS AND ADVANTAGES OF THE INVENTION

It is an object of the present invention to overcome the problems and difficulties associated with the prior art.

It is another object of the present invention to provide a duct cleaning apparatus that is easy to use and store.

It is another object of the present invention to provide a duct cleaning apparatus that is inexpensive to purchase and adaptable to household vacuum cleaners.

It is still another object of the present invention to provide a duct cleaning apparatus that is able to agitate dirt with compressed air within the vacuum zone of a suction hose.

Still further objects and advantages of our invention will become apparent from a consideration of the following diagrams and detailed description.

DETAILED DESCRIPTION

Figure 1:
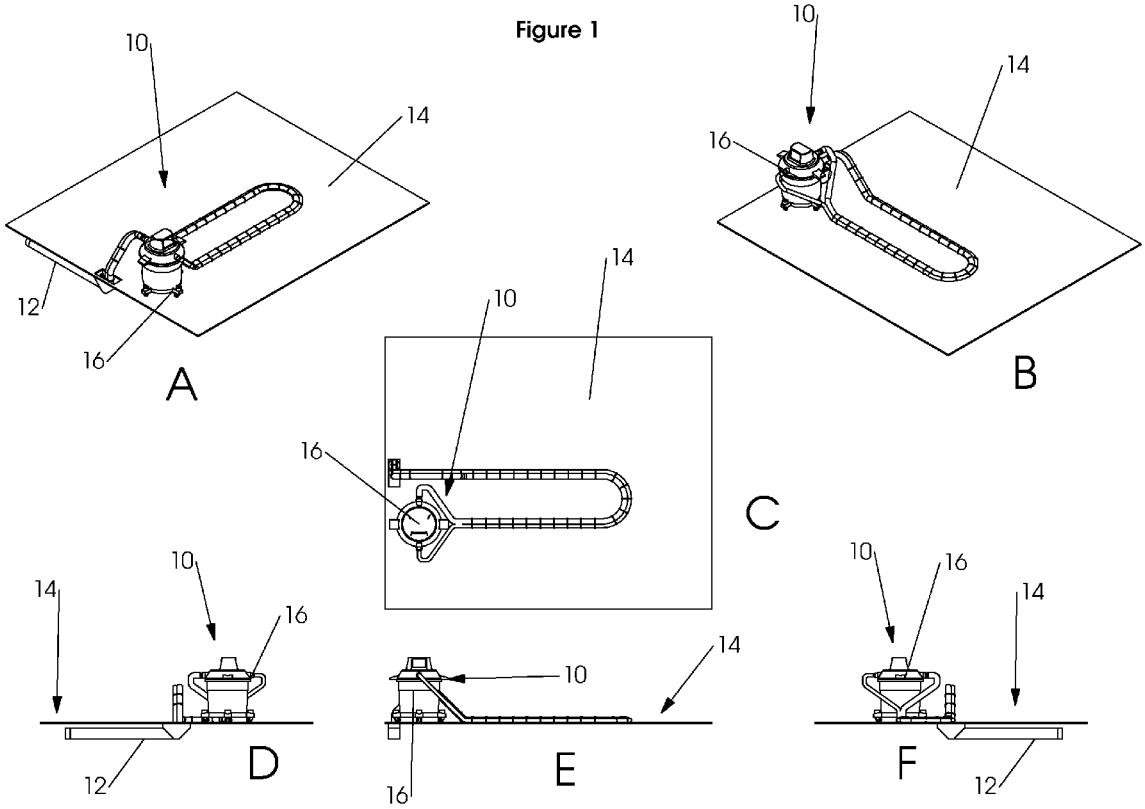
FIGS. 1A-F comprises various views of one example of my invention.

Referring to FIG. 1 views A to F, my invention (10) is a duct cleaning apparatus for cleaning debris from household ducts (12) commonly located beneath flooring (14). The invention is adapted for use for forced air heating and cooling systems in residential and commercial applications using a standard 5 inch duct. However, the invention can be adapted for larger or smaller ducts. My invention can be used with a portable household or light industrial shop vacuum cleaner (16) as illustrated.

Figure 2:
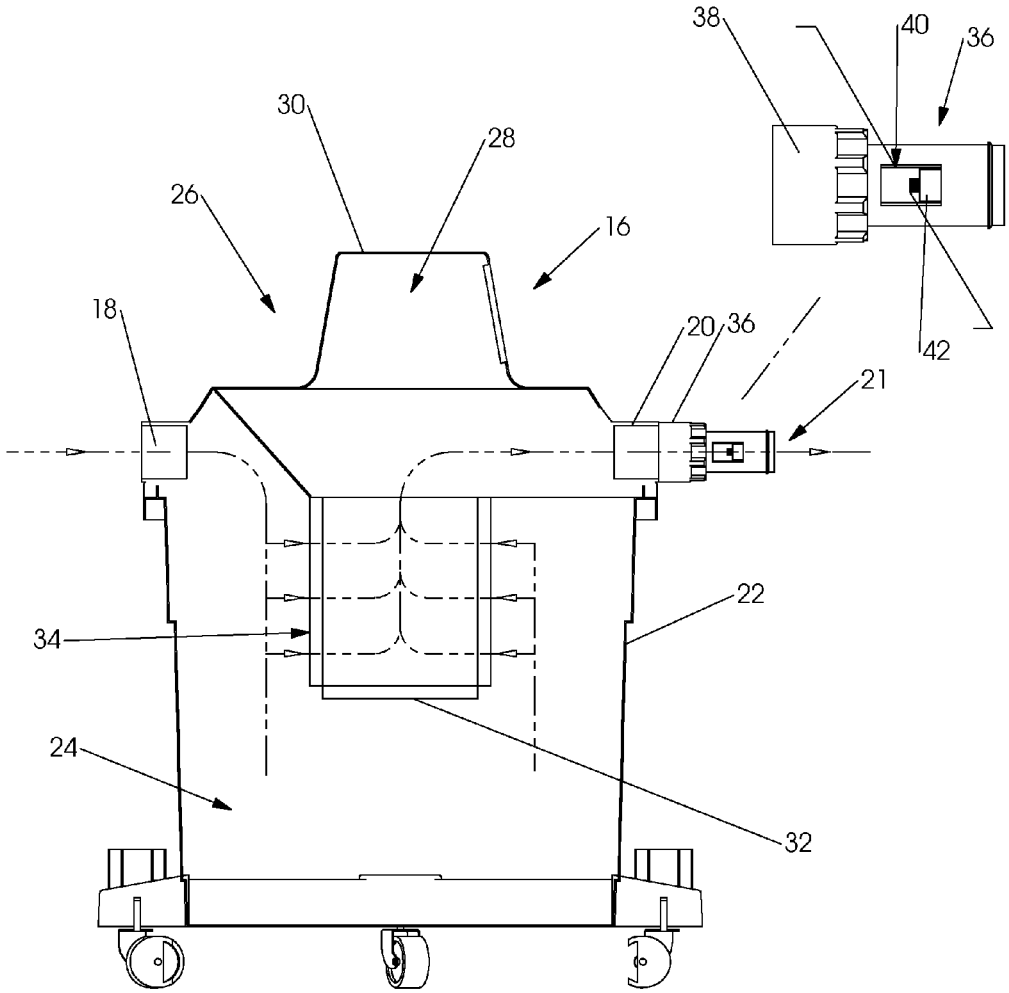
FIG. 2 shows one view of a typical industrial vacuum cleaner that may be used with one example of my invention.

Referring to FIG. 2, a typical light industrial shop vacuum cleaner (16) generally has a 2.5 inch vacuum or suction connection (18) and a 2.5 inch blower exhaust or blower connection (20). The vacuum source of my invention comprises a sealed container (22) having a volume (24) for collecting debris from duct (12). The volume (24) within the container (22) is under a negative pressure induced by means for creating negative pressure (26) comprising a motor and blower assembly (28) contained in housing (30). The means for creating negative pressure (26) is typically located within the housing (30) but in other examples of my invention it could be located outside of the sealed container but in communication with the sealed container. Typically the motor and blower assembly (28) further comprises a suction plenum (32) surrounded by a filter (34).

Still referring to FIG. 2, blower output pressure (21) is controlled by a blower controller as attachment (36) that fits over the blower connection (20) and comprises a body (38), an aperture (40) and a sliding gate (42) over the aperture. The sliding gate acts to bleed pressure from the hose as it is opened from a first closed position to a fully open position. The body is connected the blower hose. The attachment body (38) reduces the blower hose size from 2½" to 1¼". The positioning of the sliding gate determines the air volume and air pressure delivered to the blower nozzle at the end of the 1¼" hose. The purpose of the vent is to adjust the volume of air being delivered at the end of the blower hose (or the envelope area) so that this area maintains a negative air pressure environment thereby preventing airborne dust from escaping this area. To adjust the blower hose output to the correct pressure at the end of the blower hose, the suction and blower hose ends are put into the duct about 2 feet and the vacuum is turned on. If there is air blowing out of the duct, the blower hose vent is adjusted until the air stops blowing out of the floor vent.

Figure 3:
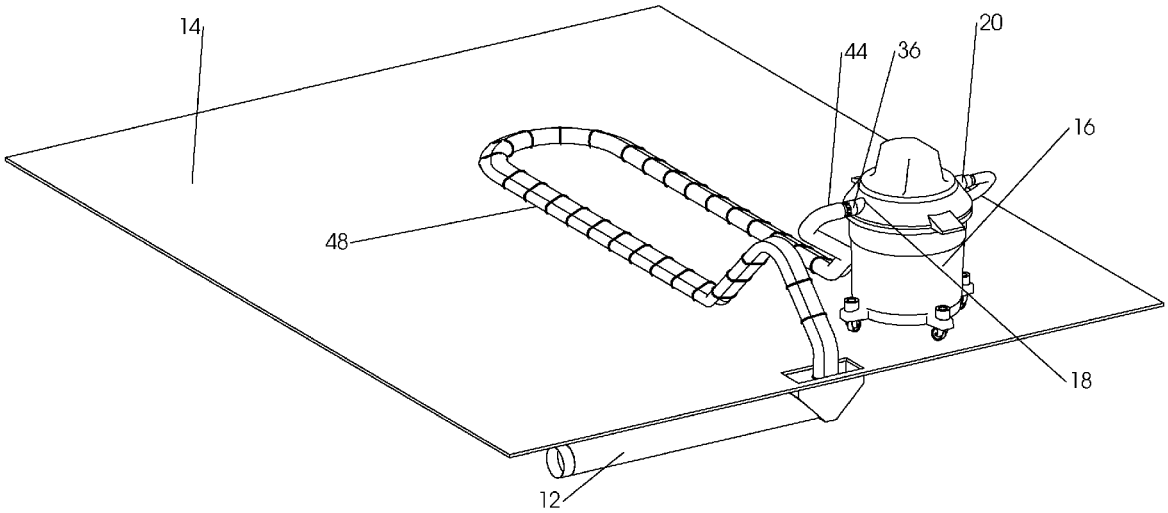
FIG. 3 is view of one example of my invention as it would appear with the nozzle within a duct.

Referring to FIG. 3, the invention further comprises a first hose (46) being a blower hose connected to the blower connection (20) through a blower controller (36). There is also a second hose being a suction hose (44) connected to the suction connection (18). Circled area "A" in FIG. 3 is shown in greater detail in FIG. 4.

Figure 4:
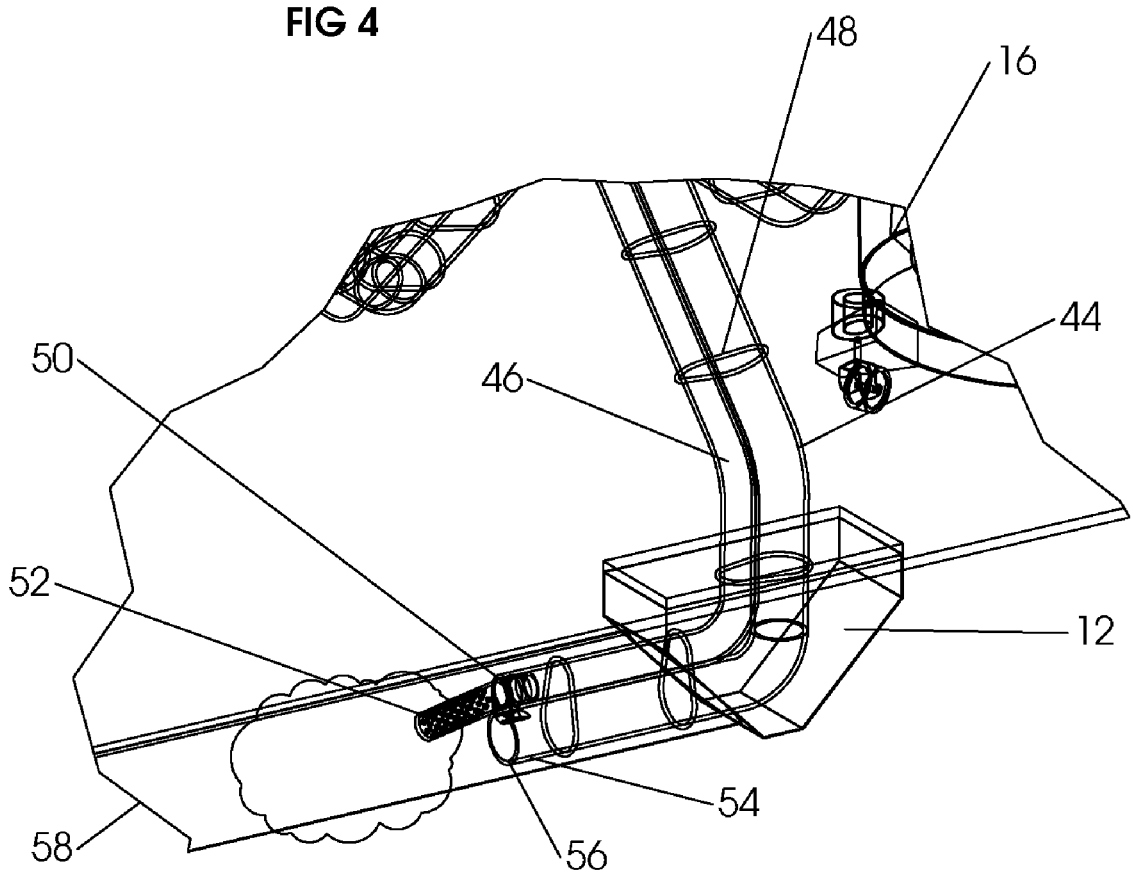
FIG. 4 is a more detailed view of the nozzle of one example of my invention operating within a duct.

Referring to FIG. 4, there is shown the circled area "A" in FIG. 3 in greater detail. Suction hose (44) is shown in a parallel configuration with blower hose (46). The hoses are held in a parallel configuration by a plurality of elastic bands (48). The suction hose generally has a diameter of 2.5 inches whereas the blower hose has a diameter of 1.25 inches which increases the velocity of the air through the hose. Attached to the end (50) of the blower hose (46) is a blower nozzle (52). Attached to the end of the suction hose (44) is a suction nozzle (54). The blower nozzle directs air radially (56) in order to disturb dust and debris within the suction zone (58) of the suction nozzle so that it can be sucked into the suction hose and directed to the vacuum cleaner (16). The suction zone (58) is where the most active suction will occur within the duct (12) in order to displace dust and debris into the suction hose. For that reason, the bulk of air from the blower nozzle (52) is directed (56) by the depressed angle of the nozzle into the suction zone.

Figure 5:
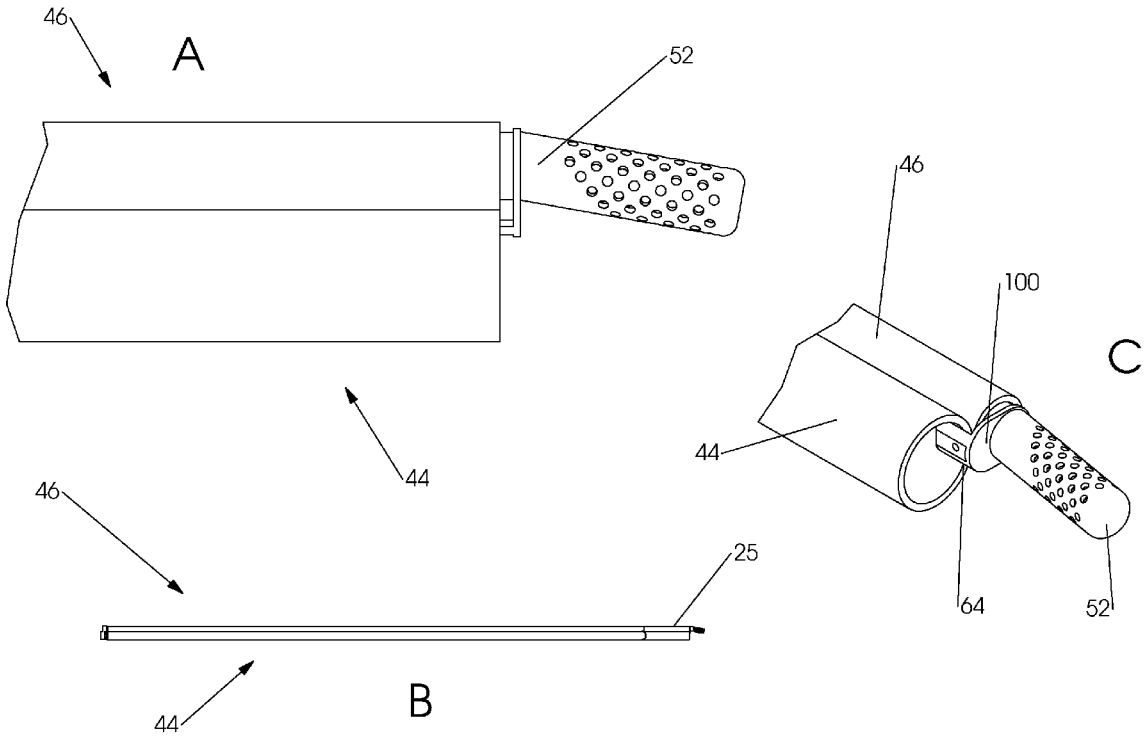
FIG. 5 is a plurality of views of the suction and blower hoses in adjacent and parallel relationship and the position of the nozzle in one example of my invention.

Referring to FIG. 5 A to C, there is shown the two parallel hoses, suction (44) and blower (46) in parallel alignment in one example of my invention. Attached to the end of the blower hose is the blower nozzle (52). The two hoses are of equal length and may be segmented so that it can be disassembled for easy transportation and storage. The nozzle is angled downward in order to direct air into the suction zone. View C illustrates how member (64) and flange (100) on the blower nozzle (52) cooperate with the end of the suction hose to hold the nozzle in place.

Figure 6:
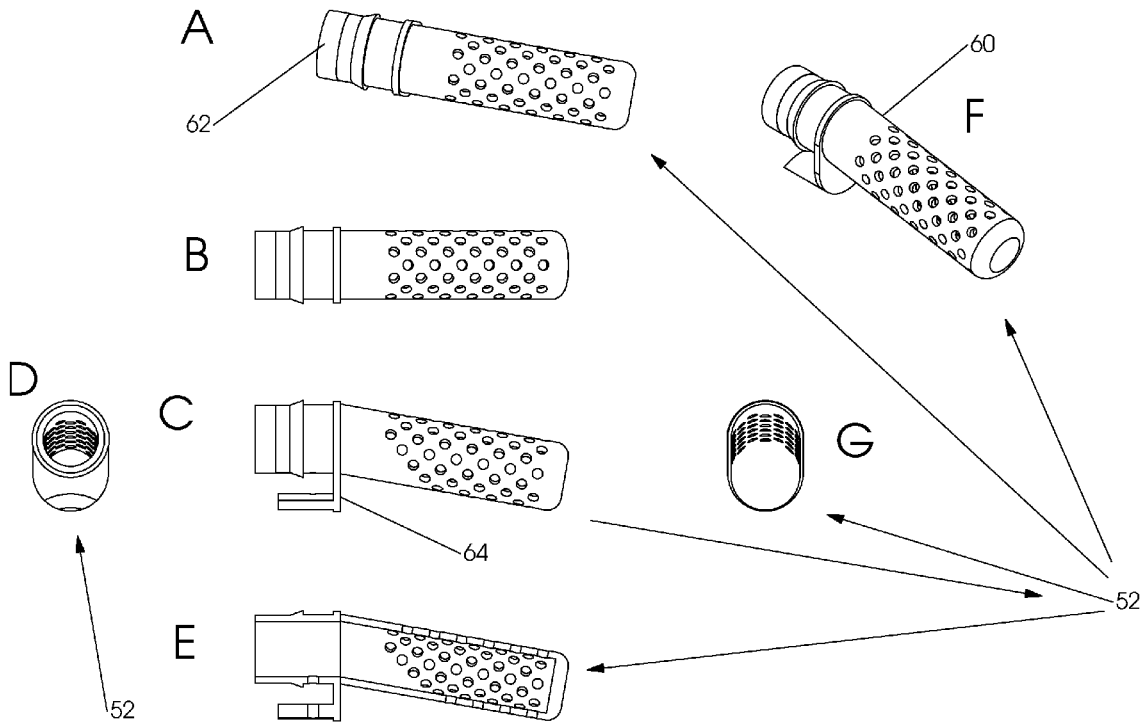
FIGS. 6A-G is a variety of views of the nozzle of one example of my invention.

Now referring to FIG. 6 A to G there are shown various views of the blower nozzle (52) of the invention. Blower nozzle (52) comprises a first part (60) for blowing air radially into the duct; a second part (62) for connecting to the second end of the suction hose; and, a third part (64) for attaching the nozzle to the blower hose.

Figure 7:
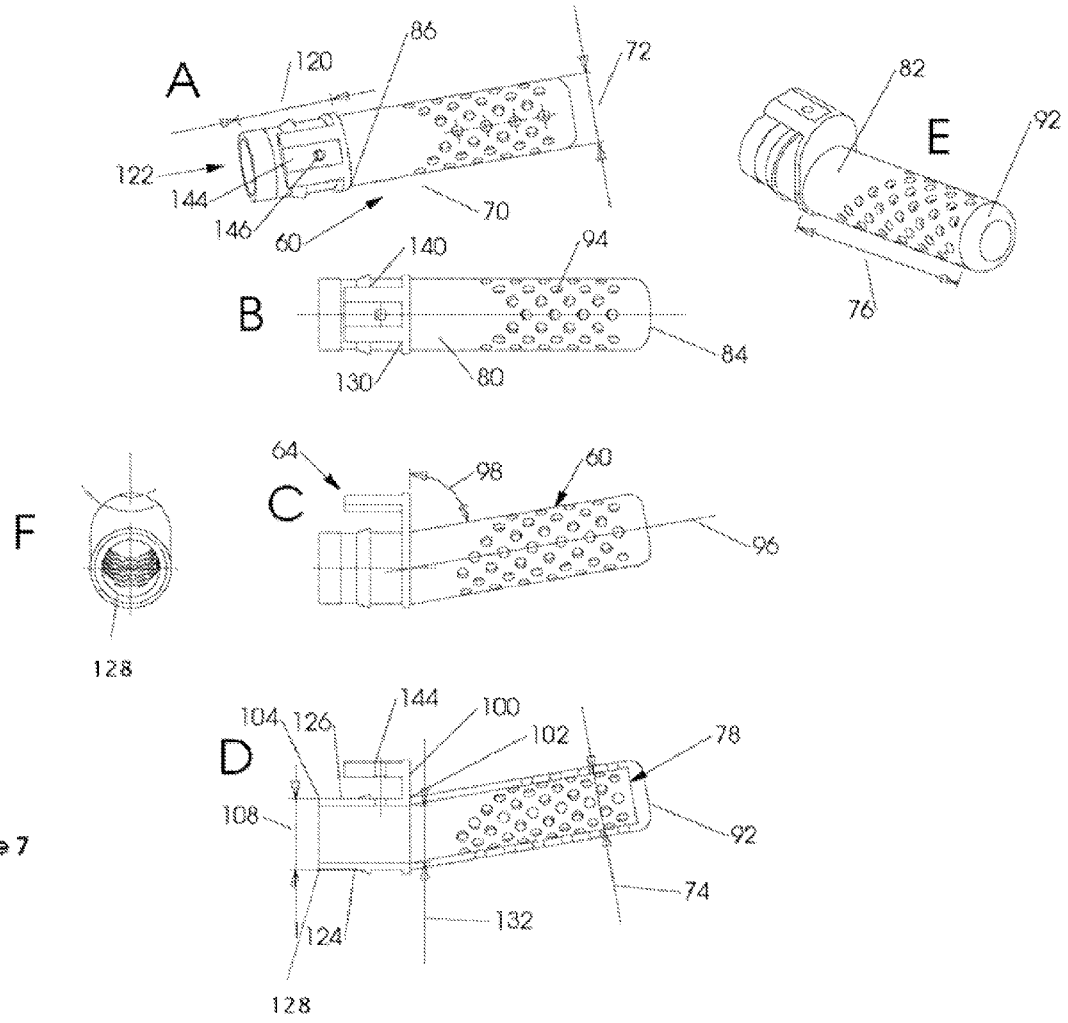
FIG. 7 is a variety of views of the nozzle in another example of my invention.

Referring to FIG. 7 A to G there is shown various views of the blower nozzle with dimensions suited to one preferred example of the inventions. These dimensions can be changed to suit the application of the nozzle. The first part of the nozzle (60) comprises a first tube (70) having a closed first tube first end (84) an outside diameter (72), an inside diameter (74), a length (76), a lumen (78), a top surface area (80), a bottom surface area (82) and a first tube second end (86). The first tube first end has a rounded surface (92) to move over duct joints without snagging. The top (80) and bottom (82) surface areas are perforated with a plurality of equally-sized holes (94) for blowing compressed air into the suction zone of the suction hose. There are more holes on the top surface than the bottom surface. The first tube further comprises an axis (96) inclined downward at a predetermined angle (98) so that air exiting the apertures impinges within the vacuum zone of the suction hose.

Still referring to FIG. 7 A to F, the second part (62) comprises a flange (100), a flange aperture (102) and a second tube (104) having an outside diameter (106), an inside diameter (108), a length (120), a lumen (122), a top surface area (124) and a bottom surface area (126), a second tube first end (128) and a second tube second end (130). The flange aperture has a diameter (132) equal to the first tube inside diameter (74) and the second tube inside diameter (108). The first tube and the second tube are joined at the flange aperture (132). The second tube comprises an encircling pointed band (140) disposed between the second tube second end (128) and the flange (100). The band has an outside diameter (142) which is greater than the outside diameter (106) of the second tube second end. The band is adapted for connection with the end of the blower hose to permanently fix the blower nozzle in place. The third part (64) comprises a resilient member (144)

projecting rearward from the flange (100). The member (144) comprises an aperture (146). The member (144) cooperates with the encircling pointed band (140) so that end of the second nozzle may be placed between the resilient member and the encircling pointed band in abutment against the flange and held compressively thereby permanently fixing the blower nozzle to the suction nozzle.

Referring to back to FIG. 3, the suction hose and the blower hose are held in adjacent and parallel relationship by a plurality of elastic bands (48) adapted to encircle the first (44) and second (46) hoses at regularly spaced intervals when adjacent to each other and hold them together. The elastics are generally 0.25 inches in thickness and are placed about 5 inches apart along the length of the hoses commencing about 3 feet from either end of the hoses. The outside diameter of the suction hose is generally larger than the outside diameter of the blower hose but this may vary depending on the application. Hose lengths vary but may be as long as 40 feet with effective suction although 30 feet is generally optimum. Once inserted into the duct, the hose and nozzles may be rotated within the duct and pushed forward slowly to capture loose dirt and dust which may become airborne into the home during heating and cooling. The apparatus is easily assembled and disassembled for storage.

Although the description above contains much specificity, these should not be construed as limiting the scope of the invention but as merely providing illustrations of some of the presently preferred examples of this invention. Thus the scope of the invention should be determined by the appended claims and their legal equivalents.

What is claimed is:

1. A duct cleaning apparatus comprising:

a. a sealed container having a volume for collecting debris from said duct, wherein said container is adapted to contain a negative pressure;

b. means for creating said negative pressure within said sealed container comprising a blower driven by motor means, wherein said blower has an intake and an exhaust, and wherein said intake is in communication with said sealed container volume so that air is drawn from the sealed container thereby creating the negative pressure within the volume; wherein said negative pressure is in communication with a first flexible hose adapted for suction, and wherein said first flexible hose has a first end in communication with said volume by a first attachment means and a second end having a vacuum zone and adapted for mobile placement within the duct, so that debris from the duct enters said vacuum zone and is sucked by the negative pressure into the first flexible hose second end and transported to the sealed container;

c. means for creating a positive pressure in a second flexible hose having a first end and a second end, said means comprising said exhaust connected to said first end of said second flexible hose by second attachment means, wherein said first end of the second flexible hose is in communication with the means for creating said positive pressure by second attachment means, and wherein said second end of the second flexible hose is adapted for directing air radially into the duct so that it impinges within the vacuum zone;

d. a first nozzle fixed to the second end of the second flexible hose; and, e. a second nozzle fixed to the second end of the first flexible hose, wherein the first flexible hose and the second flexible hose have an equal length and are attached parallel to each other by elastic attachment means.

2. The apparatus of claim 1 wherein said elastic attachment means comprises a plurality of elastic bands adapted to encircle the first and second hoses at regularly spaced intervals when adjacent to each other and hold them together.

3. The apparatus of claim 1 wherein the diameter of the first hose is larger than the diameter of the second hose.

4. The apparatus of claim 1 further comprising air flow regulation means comprising a body having an aperture wherein said aperture includes an adjustable gate adjustable between an open position and a closed position, and further wherein said body is serially connected between the second hose first end and the sealed container so that opening said adjustable gate results in pressure bled from the second hose so that proper air pressure is delivered to the first nozzle.

5. The apparatus of claim 1 wherein said first nozzle and said second nozzle are disposed adjacent to each other.

6. The apparatus of claim 5 wherein the first nozzle is adapted to direct air radially in front of the second nozzle to agitate debris within the duct so that it may be more completely sucked into the second nozzle.

7. The apparatus of claim 6 wherein said air is directed within said vacuum zone of the second nozzle.

8. The apparatus of claim 7 wherein the first and second flexible hoses are segmented into smaller sections for storage and transportation.

9. The apparatus of claim 8 wherein the first nozzle comprises a first part for blowing air into the duct; a second part for connecting to the second end of the second hose; and, a third part for attaching the first nozzle to the second nozzle.

10. The apparatus of claim 9 wherein said first part comprises a first tube having an outside diameter, an inside diameter, a length, a lumen, a top surface area, a bottom surface area, a first tube first closed end and a first tube second end.

11. The apparatus of claim 10 wherein said first tube first end comprises a rounded surface.

12. The apparatus of claim 11 wherein said top and bottom surface areas are perforated with a plurality of equally-sized holes, and wherein there are more holes on the top surface than the bottom surface.

13. The apparatus of claim 12 wherein the first tube further comprises an axis, wherein said axis is inclined downward at a predetermined angle so that air exiting said equally-sized holes impinges within the vacuum zone of the second nozzle.

14. The apparatus of claim 13 wherein said second part comprises a flange, a flange aperture and a second tube having an outside diameter, an inside diameter, a length, a lumen, a top surface area and a bottom surface area, a second tube first end and a second tube second end.

15. The apparatus of claim 14 wherein said flange aperture has a diameter equal to the first tube inside diameter and the second tube inside diameter, and further wherein said first tube second end and said second tube first end are joined at the flange.

16. The apparatus of claim 15 wherein the second tube comprises an encircling pointed band disposed between the second tube second end and the flange, said collar having an outside diameter greater than the outside diameter of the second tube second end.

17. The apparatus of claim 16 wherein said third part comprises a resilient member projecting rearward from the flange, and wherein said member comprises an aperture therein, and further wherein said resilient member cooperates with said encircling pointed band so that end of the second nozzle may be placed between the resilient member and the encircling pointed band in abutment against the flange and held compressively thereby temporarily fixing the first nozzle to the second nozzle.

* * * * *